US007841036B2

(12) United States Patent
Smith

(10) Patent No.: US 7,841,036 B2
(45) Date of Patent: Nov. 30, 2010

(54) HAND-HELD ROLLER DEVICE WITH COVER FOR PROVIDING BENEFITS TO FABRICS

(75) Inventor: Christopher Lawrence Smith, Liberty Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 1131 days.

(21) Appl. No.: 11/177,117

(22) Filed: Jul. 8, 2005

(65) Prior Publication Data

US 2006/0009337 A1 Jan. 12, 2006

Related U.S. Application Data

(60) Provisional application No. 60/586,496, filed on Jul. 9, 2004, provisional application No. 60/587,561, filed on Jul. 12, 2004.

(51) Int. Cl.
*A47L 25/00* (2006.01)

(52) U.S. Cl. ..... 15/104.002; 15/230.11; 15/247

(58) Field of Classification Search ..... 15/247, 15/230.11, 104.002; 492/13
See application file for complete search history.

(56) References Cited

U.S. PATENT DOCUMENTS 3,623,179 A * 11/1971 Roth ..... 15/104.001
4,361,923 A 12/1982 McKay
4,399,579 A 8/1983 McKay
4,422,201 A 12/1983 McKay
4,557,011 A 12/1985 Sartori
4,570,280 A 2/1986 Roth
4,575,890 A 3/1986 Hidle
4,713,274 A 12/1987 Minor
4,727,616 A 3/1988 Kucera
4,811,444 A 3/1989 Hamblin
4,820,558 A 4/1989 Sundberg
4,887,858 A 12/1989 Gazzarrini
4,905,337 A 3/1990 McKay
4,920,662 A 5/1990 Seeburger
4,979,257 A 12/1990 Heneveld
4,990,192 A 2/1991 Pallone et al.

(Continued)

FOREIGN PATENT DOCUMENTS

EP 0 966 915 A1 12/1999

(Continued)

OTHER PUBLICATIONS

Computer Generated English translation of WO 01/01844, Jan. 2000, Brison.*

(Continued)

*Primary Examiner*—Laura C Guidotti
(74) *Attorney, Agent, or Firm*—Mark A Charles; David V Upite; Melissa G Krasovec

(57) ABSTRACT

Hand-held roller article for providing benefits to fabric. The present invention relates to utilizing a hand-held roller article for providing benefits to fabrics. The hand-held roller article comprises a substrate formed into a roll wherein the substrate may include one or more benefit agents for providing benefits to fabrics. The hand-held roller article also includes a roller device comprising a handle connected to the substrate roll and a cover for covering the substrate roll.

6 Claims, 12 Drawing Sheets

U.S. PATENT DOCUMENTS

| | | | |
|---|---|---|---|
| 5,027,465 | A | 7/1991 | McKay |
| 5,089,160 | A | 2/1992 | Pallone et al. |
| 5,148,571 | A | 9/1992 | Brazis et al. |
| 5,153,254 | A | 10/1992 | Chen |
| 5,230,303 | A | 7/1993 | Rubino |
| 5,333,341 | A | 8/1994 | Heneveld |
| 5,388,300 | A | 2/1995 | Hickey et al. |
| 5,533,223 | A | 7/1996 | Ho |
| 5,548,861 | A | 8/1996 | Hukuba |
| 5,553,344 | A | 9/1996 | Rosenkrantz |
| 5,569,521 | A | 10/1996 | Francoeur et al. |
| 5,575,031 | A | 11/1996 | Chai |
| 5,616,387 | A | 4/1997 | Augst et al. |
| 5,650,215 | A | 7/1997 | Mazurek et al. |
| 5,742,969 | A | 4/1998 | Pociejewski et al. |
| 5,763,038 | A | 6/1998 | Wood |
| 5,878,457 | A | 3/1999 | Cox et al. |
| 5,894,623 | A | 4/1999 | Thill |
| 5,922,427 | A | 7/1999 | King |
| 5,940,921 | A | 8/1999 | Wood et al. |
| 6,014,788 | A | 1/2000 | Jaffri |
| 6,024,970 | A | 2/2000 | Woodard |
| 6,055,695 | A | 5/2000 | McKay, Jr. |
| 6,127,014 | A | 10/2000 | McKay, Jr. |
| 6,197,397 | B1 | 3/2001 | Sher et al. |
| 6,343,397 | B1 | 2/2002 | Odagiri |
| 6,349,443 | B1 * | 2/2002 | Randolph et al. ..... 15/114 |
| 6,425,136 | B1 | 7/2002 | Schlamp et al. |
| 6,427,278 | B1 | 8/2002 | McKay, Jr. |
| 6,449,794 | B1 | 9/2002 | Jaffri |
| 6,460,191 | B1 | 10/2002 | Lorkovic |
| 6,576,323 | B2 | 6/2003 | Wise et al. |
| 6,688,464 | B2 | 2/2004 | Jessen et al. |
| 2002/0088070 | A1 | 7/2002 | Cho |
| 2002/0124335 | A1 | 9/2002 | Franko |
| 2002/0144367 | A1 | 10/2002 | McKay, Jr. |
| 2003/0039822 | A1 | 2/2003 | Aalbers |
| 2003/0039824 | A1 | 2/2003 | Aalbers |
| 2003/0088928 | A1 | 5/2003 | Otsuka et al. |
| 2003/0096074 | A1 | 5/2003 | Kim |
| 2003/0135941 | A1 | 7/2003 | Vosbikian |
| 2003/0154569 | A1 | 8/2003 | McKay |
| 2003/0165650 | A1 | 9/2003 | Hirota et al. |
| 2003/0167583 | A1 | 9/2003 | Shizuno et al. |
| 2003/0209564 | A1 | 11/2003 | McKay |
| 2003/0209565 | A1 | 11/2003 | McKay |
| 2003/0229958 | A1 | 12/2003 | Thompson et al. |
| 2004/0007252 | A1 | 1/2004 | Namikawa et al. |
| 2004/0052570 | A1 | 3/2004 | McKay |
| 2004/0058116 | A1 | 3/2004 | Sano et al. |

FOREIGN PATENT DOCUMENTS

| | | | |
|---|---|---|---|
| FR | 2 692 132 | | 12/1993 |
| GB | 2 204 228 | A | 11/1988 |
| GB | 2 379 382 | A | 3/2003 |
| IT | 00 238 791 | | 12/1995 |
| JP | 07-023890 | A | 1/1995 |
| JP | 2002-315718 | A | 10/2002 |
| WO | WO 83/01734 | | 5/1983 |
| WO | WO 01/01844 | A1 * | 1/2001 |
| WO | WO 01/81011 | A1 | 11/2001 |
| WO | WO 02/083834 | A1 | 10/2002 |

OTHER PUBLICATIONS

U.S. Appl. No. 11/177,657, filed Jul. 8, 2005, Catalfamo et al.
U.S. Appl. No. 29/221,010, filed Jan. 10, 2005, Catalfamo et al.
U.S. Appl. No. 29/221,011, filed Jan. 10, 2005, Catalfamo et al.
U.S. Appl. No. 29/221,040, filed Jan. 10, 2005, Smith et al.
International Search Report mailed Nov. 14, 2005, 5 pages.

* cited by examiner

HAND-HELD ROLLER DEVICE WITH COVER FOR PROVIDING BENEFITS TO FABRICS

CROSS REFERENCE TO RELATED APPLICATIONS

This application claims the benefit of U.S. Provisional Application Ser. No. 60/586,496 filed on Jul. 9, 2004 and U.S. Provisional Application Ser. No. 60/587,561 filed on Jul. 12, 2004.

FIELD

The present invention relates to a hand-held roller device which includes a cover.

BACKGROUND

Hand-held roller devices (e.g. lint rollers and the like) typically comprise a handle (which is capable of holding a substrate formed into a roll), a roll of substrate which is attached to the handle, and a cover to enclose the substrate. The substrate is generally comprised of a plurality of wraps wherein each wrap is separated from the next adjacent wrap by some type of separation such as slits, perforations, or the like. In many instances, the substrate is treated with some type of benefit agent for providing benefits to fabric. For instance, the outwardly facing side of the substrate may be adhesively treated in order to promote removal of lint and other contaminants from surfaces of fabric when the hand-held roller device is rolled on the fabric.

The cover utilized to enclose the substrate is typically comprised of a cellulosic or non-cellulosic sheet material. One of the drawbacks of such a cover stems from the difficulty in maintaining axial alignment of the cover to the substrate when removing or replacing the cover. Often times some part of the substrate is left exposed to the environment when not in use. This can result in damage to the substrate and/or degradation in product performance. For example, if left exposed, the exposed areas of the substrate can pick up unintended contaminants such as dirt and debris thus unintentionally wasting the sheet(s) of substrate thereby reducing substrate life. Additionally, without a cover, the substrate edge or surface is subject to blunt impact. Damage to the substrate can make removal of the exposed substrate wrap from the next adjacent wrap difficult. Yet further, exposure of the substrate can result in degradation of benefit agents added to the substrate. For example, if left exposed to the environment when not in use, volatile materials incorporated with the substrate (e.g.; perfume and the like) may tend to prematurely volatilize thereby reducing the amount of benefit agent available during use.

Yet further, in some instances, it may be difficult for the hand-held roller device to stand in an upright/vertical position during storage. This is generally due to the shape of the roll and/or the small amount of surface contact on the end of the device relative to overall device height.

The present invention addresses these drawbacks by providing a roller device comprised of two non-symmetrical halves that attach together to form a handle, a roller hub, and a cover guide shaft. The invention also relates to a cover comprised of a guidepost that works in conjunction with the cover guide shaft of the device for removing and replacing the cover onto the roller device in a controlled manner. The invention eliminates the cover sticking to the substrate roll as the guidepost allows for axial alignment between the cover and the roller device when the cover is placed back on and/or removed from the roller device. This also helps protect the substrate roll from damage. Yet further, as exposure of the substrate roll when not in use is reduced, there is less opportunity for degradation of product performance. Even further, the cover of the present invention provides a stable base for the roller article thereby facilitating storage of the article in a vertical position.

SUMMARY OF THE INVENTION

The present invention relates to a roller article. The roller article comprises:

a handle and a cover. The handle comprises two non-symmetrical halves including a first housing and a second housing that attach together. The cover includes a cover guide post. The handle includes a roller hub which includes a guide shaft for receiving the cover guide post. The cover guide post may be axially aligned with the hub. The roller article may include one or more vent slots. The roller article may also include one or more reinforcement ribs.

DETAILED DESCRIPTION

Reference will now be made in detail to various embodiments of the present invention, examples of which are illustrated in the accompanying drawings wherein like numerals indicate the same elements throughout the views. All percentages, ratios and proportions herein are on a weight basis unless otherwise indicated.

Except as otherwise noted, all amounts including quantities, percentages, portions, and proportions, are understood to be modified by the word "about", and amounts are not intended to indicate significant digits.

Except as otherwise noted, the articles "a", "an", and "the" mean "one or more". As used herein, "comprising" means that other steps and other ingredients/materials which do not affect the end result can be added. This term encompasses the terms "consisting of" and "consisting essentially of". The present invention can comprise, consist of, and consist essentially of the essential elements and limitations of the invention described herein, as well as any of the additional or optional materials, components, steps, or limitations described herein.

As used herein, "benefit agent" refers to a material or mixture of materials which provide benefits to fabrics. Non-limiting examples of benefit agents include perfume, softening agents, crispening agents, water/stain repellents, refreshing agents, anti-static agents, anti-microbial agents, disinfecting agents, durable press agents, wrinkle resistant agents, wrinkle release agents, odor resistance agents, malodor control agents, abrasion resistance agents, solvents, insect/pet repellents, wetting agents, UV protection agents, skin/fabric conditioning agents, skin/fabric nurturing agents, color protection agents, silicone, preservatives, bleach and/or bleach precursors, cleaning agents, fabric shrinkage-reducing agents, organic solvents, and combinations thereof.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Figure 1:
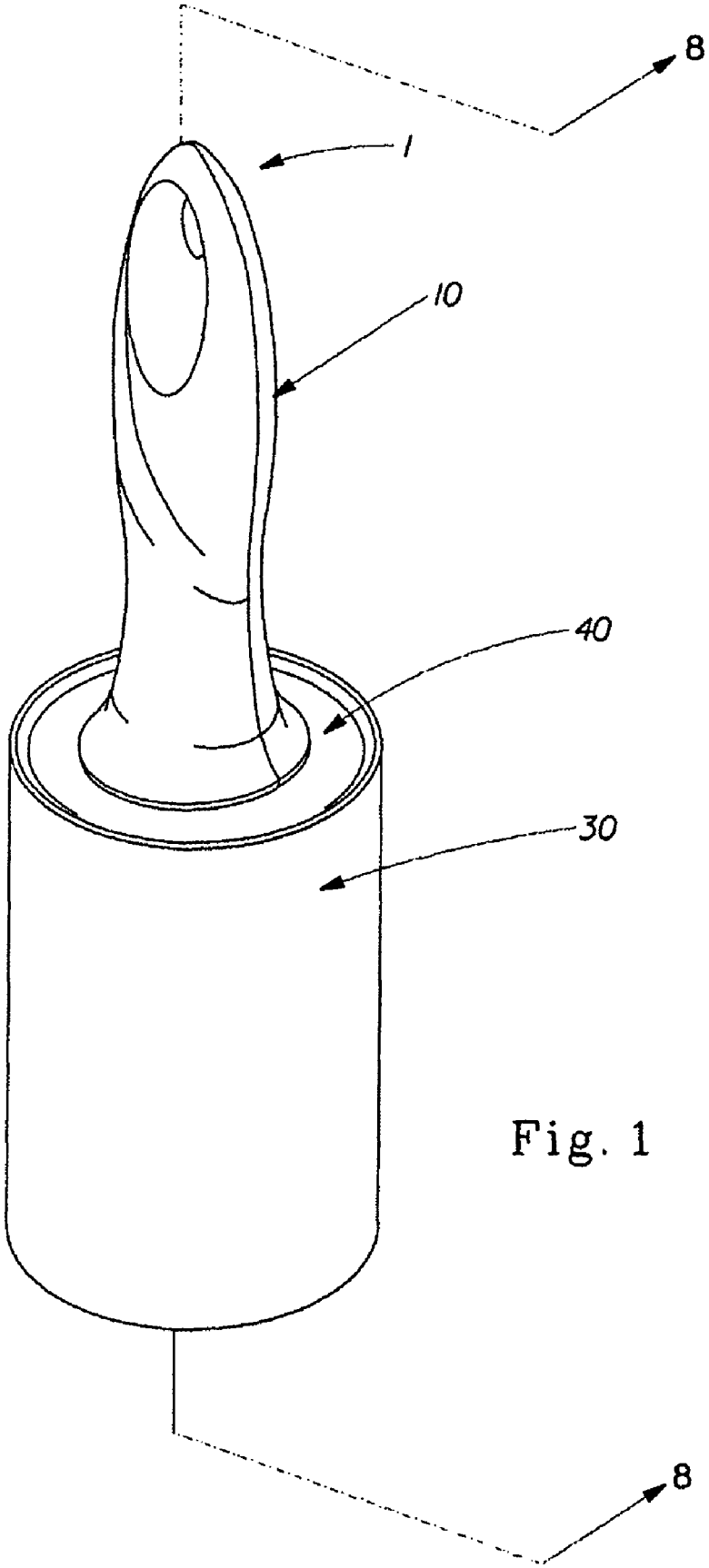
FIG. 1 is a perspective view of a roller device and cover made in accordance with the present invention.
Figure 2:
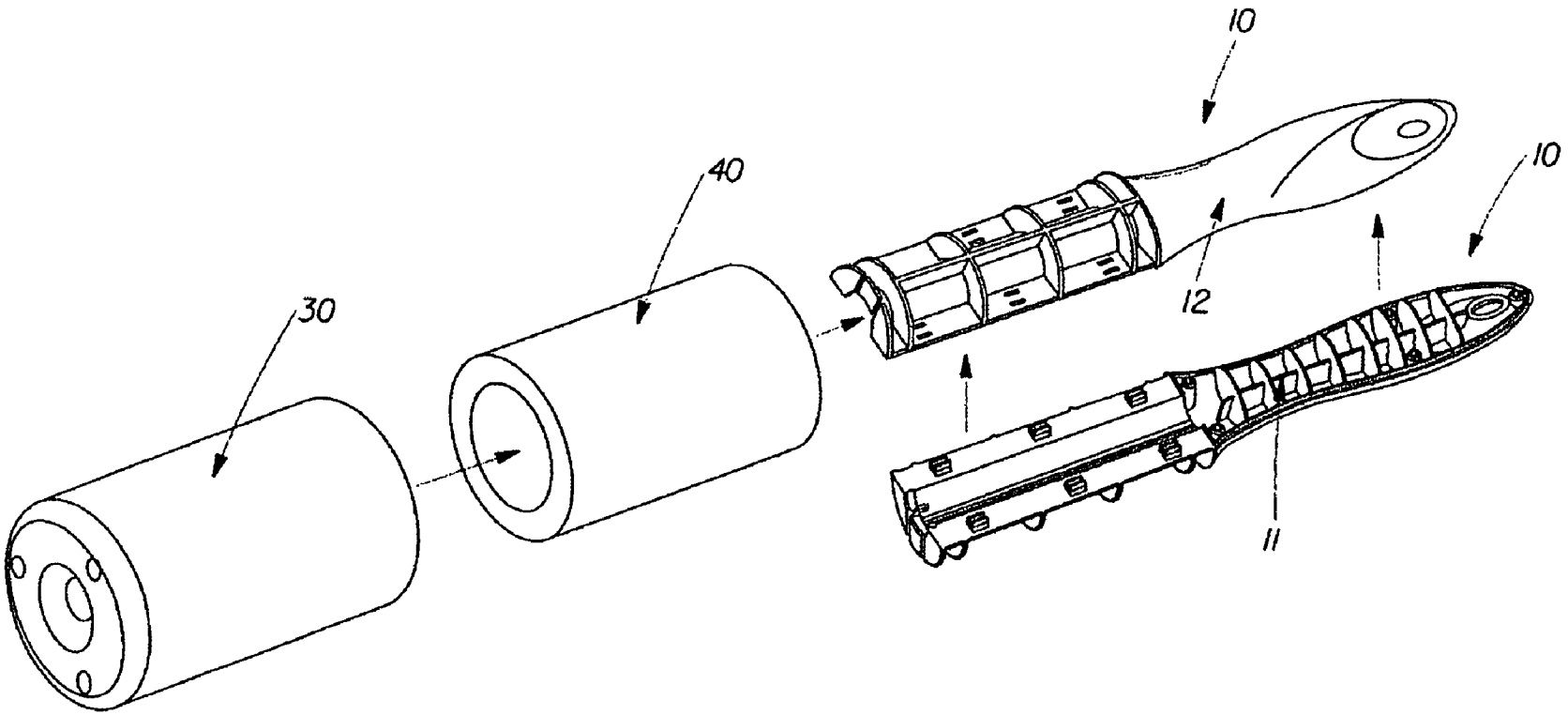
FIG. 2 is an exploded perspective view of the embodiment of FIG. 1.
Figure 3:
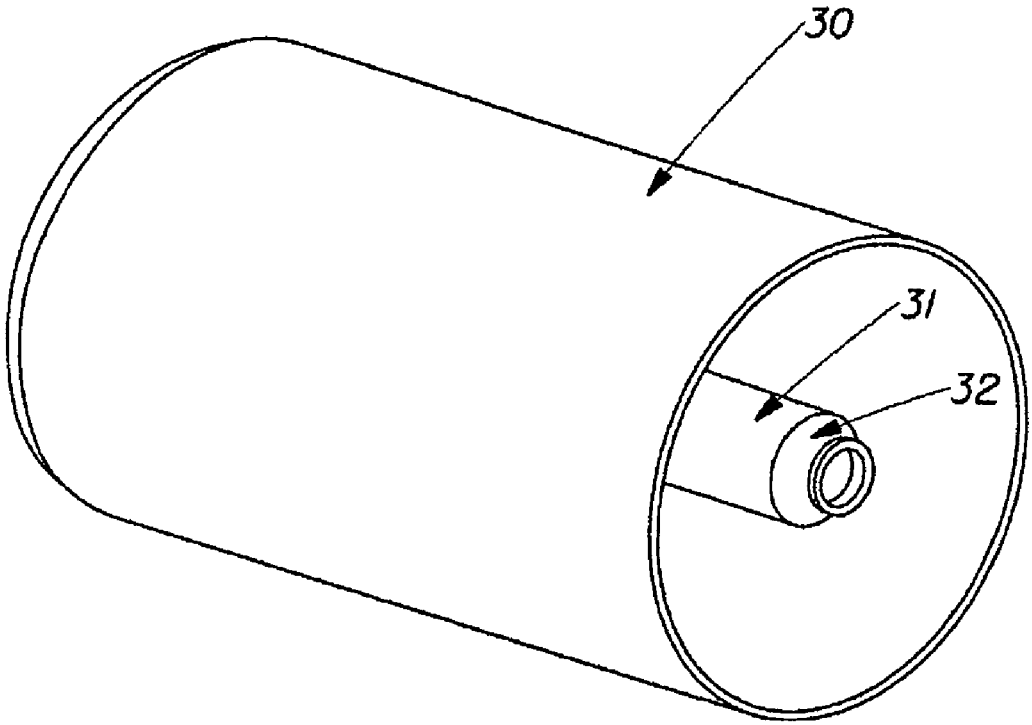
FIG. 3 is a perspective view of a cover embodiment made in accordance with the present invention showing the open end of the cover.
Figure 3A:
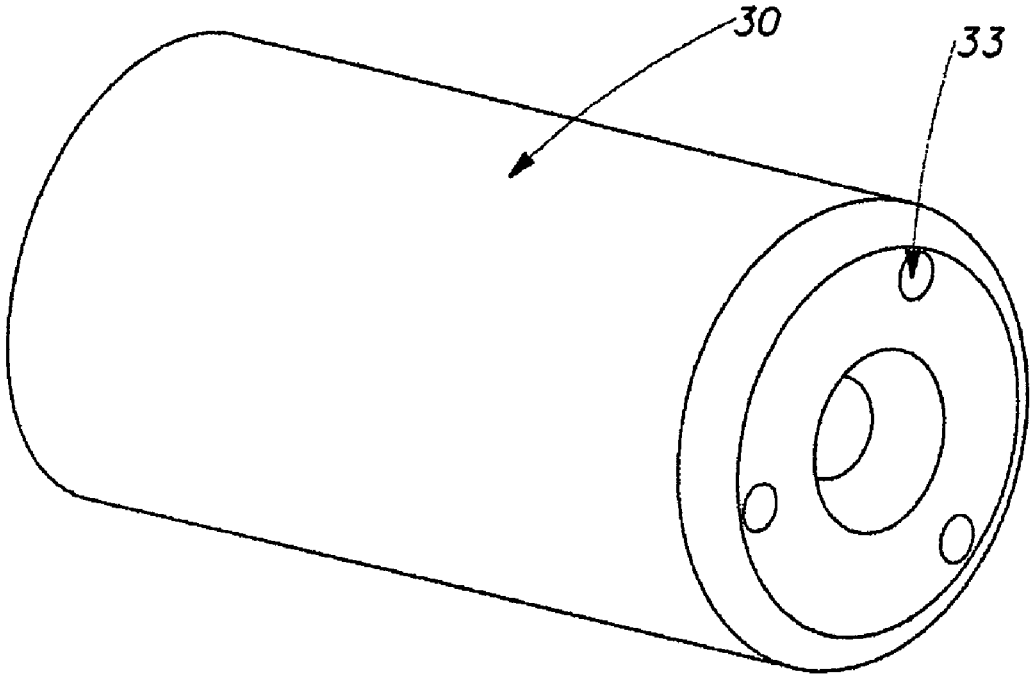
FIG. 3*a* is a perspective view of the cover embodiment of FIG. 3 taken from the opposite end showing the closed end of the cover.
Figure 4:
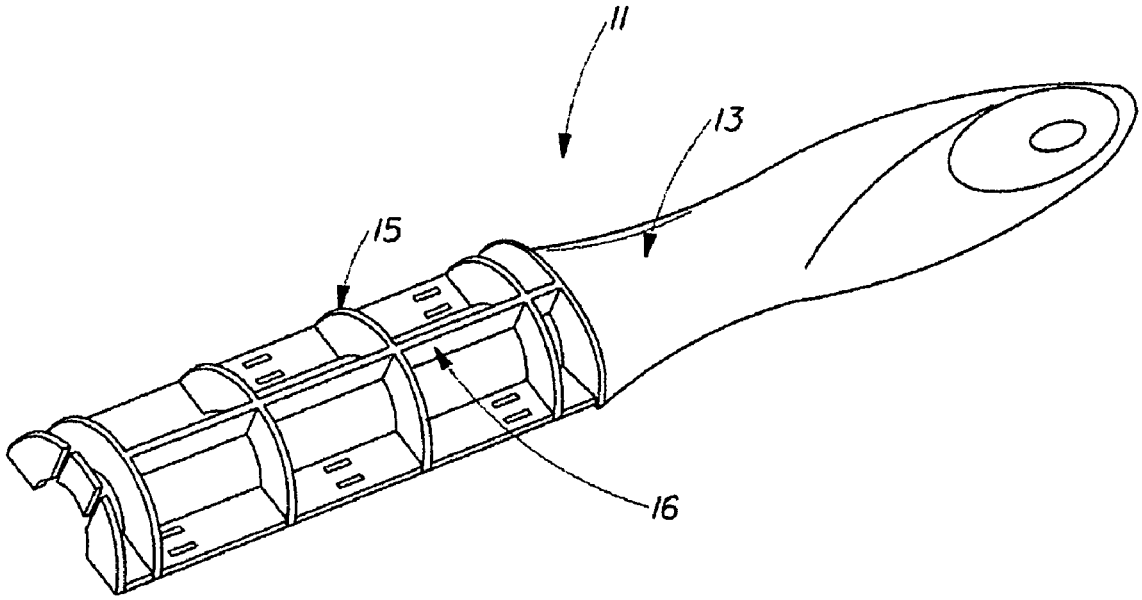
FIG. 4 is a perspective view of one non-limiting embodiment showing the outer side of a first housing for a handle.
Figure 5:
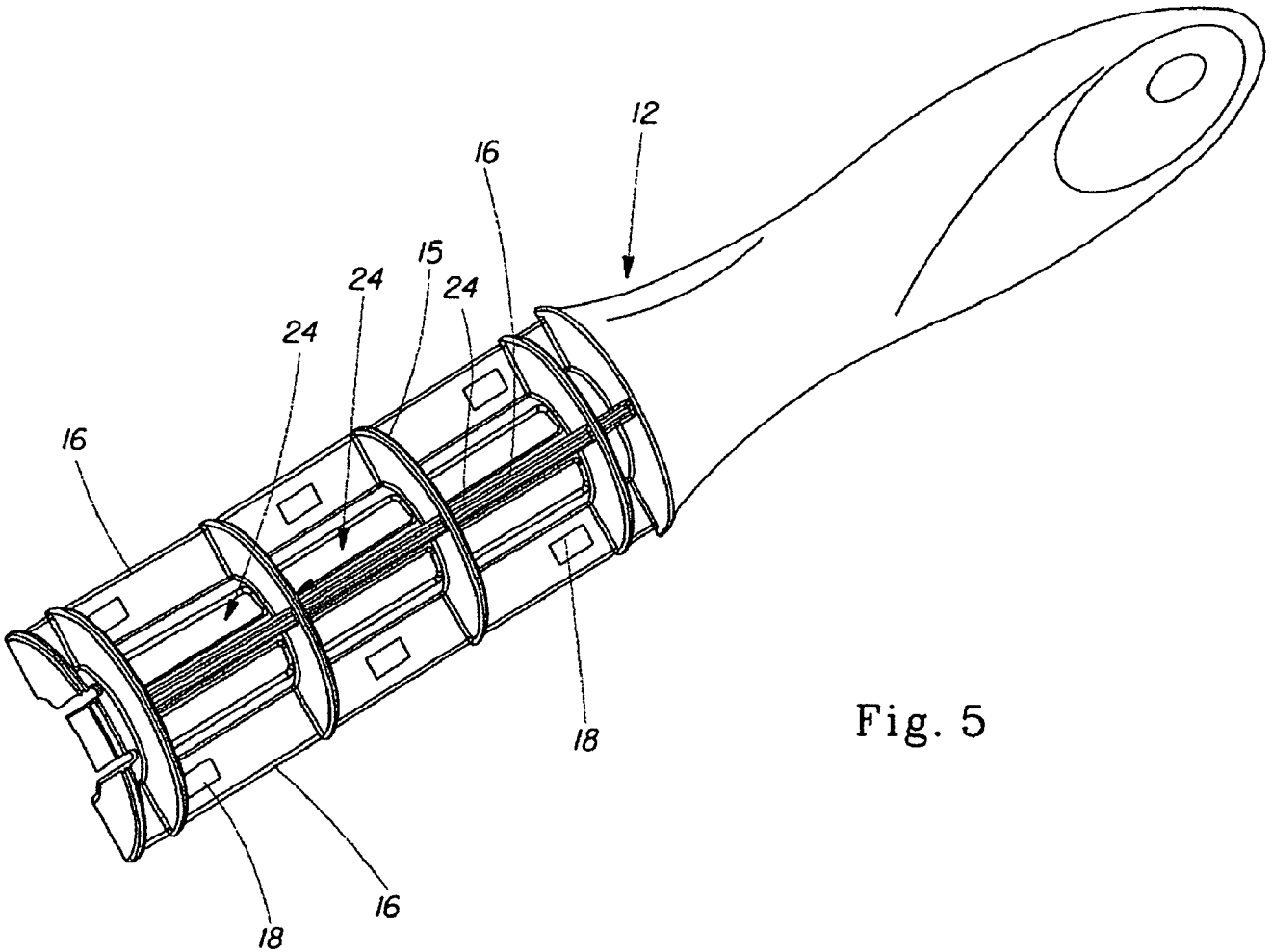
FIG. 5 is a perspective view of one non-limiting embodiment showing the outer side of a second housing for a handle.
Figure 5A:
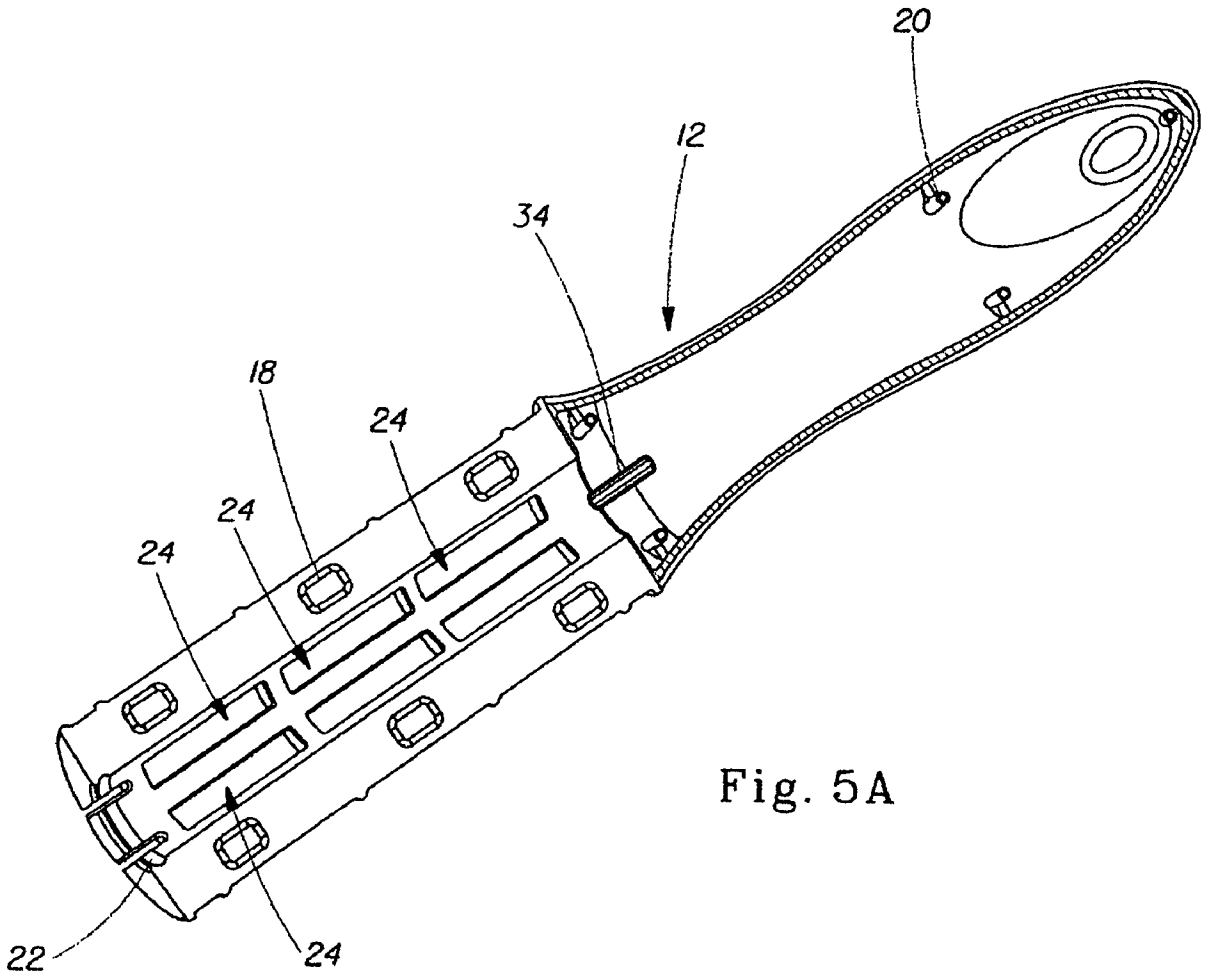
FIG. 5*a* is perspective view of the inside of the second housing of FIG. 5.
Figure 6:
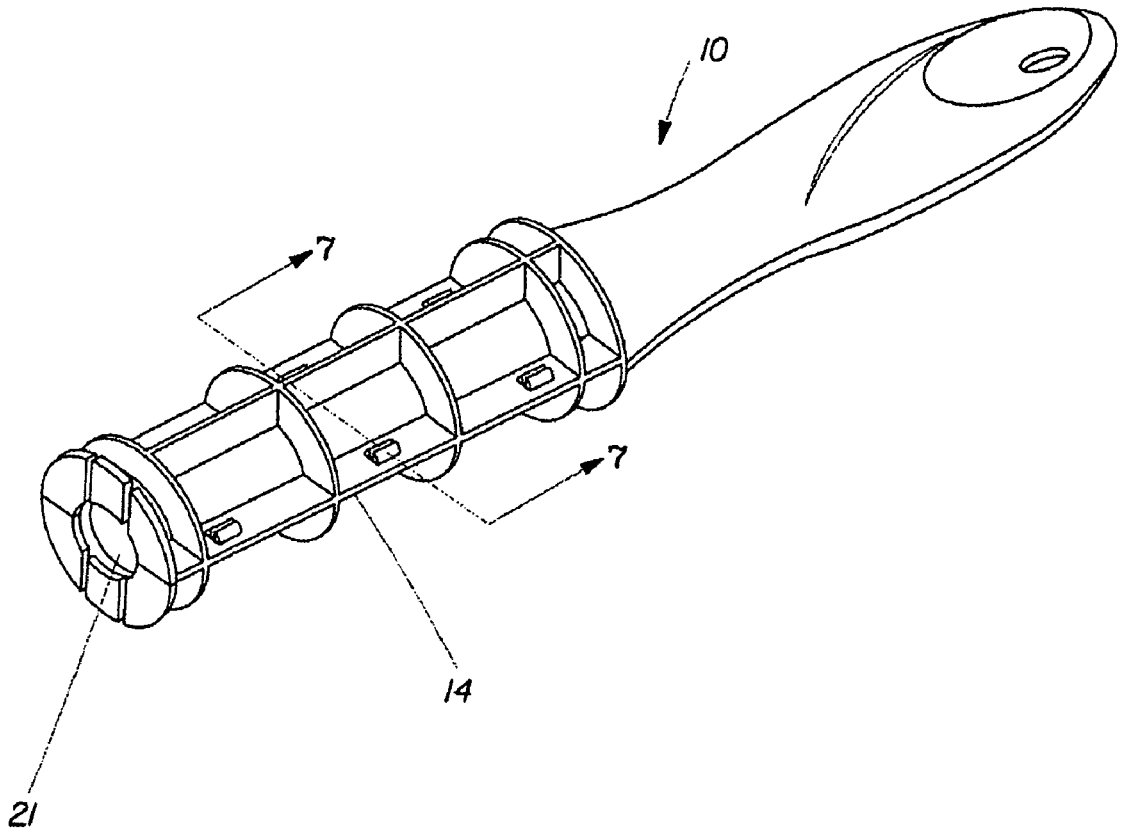
FIG. 6 is a perspective view of a handle made in accordance with the present invention.

The present invention relates to a roller device (such as a lint roller) comprised of a handle and a cover one non-limiting embodiment of which is shown in FIGS. 1-9. Referring to FIG. 1, a roller article 1 is shown. The article comprises handle 10, cover 30, and substrate 40. Referring to FIGS. 2 and 6, handle 10 is comprised of two non-symmetrical halves comprised of first housing 11 and second housing 12 that attach together. Handle 10 includes roller hub 14 and cover guide shaft 21. Cover 30 covers roller hub 14. Cover 30 and handle 10 may be comprised out of any durable material including but not limited to plastic. The plastic may be formed in different ways familiar to those of ordinary skill in the art. A substrate formed into roll 40 may be placed on roller hub 14. Referring to FIGS. 3 and 6, the cover 30 is comprised of alignment guide post 31 which fits into guide shaft 21 of hub 14. The guide post 31 includes lead-in taper 32 to help align the cover 30 with guide shaft 21. Referring Referring to FIG. 3*a*, the distal end of cover 30 (i.e.; end of cover 30 which is distal to handle 10) may include point contact 33 to help stabilize roller article 1 when placed on a surface in the vertical position (for example, it may desirable to store roller article 1 in a vertical/standing position.

Referring to FIG. 4, the exterior of first housing 11 is shown. First housing 11 includes handle 13, radial ribs 15, and axial ribs 16. Radial ribs 15 facilitate rotation of the substrate roll 40. Axial ribs 16 facilitate maintaining axial alignment of the substrate roll 40 to the hub 14.

Figure 4A:
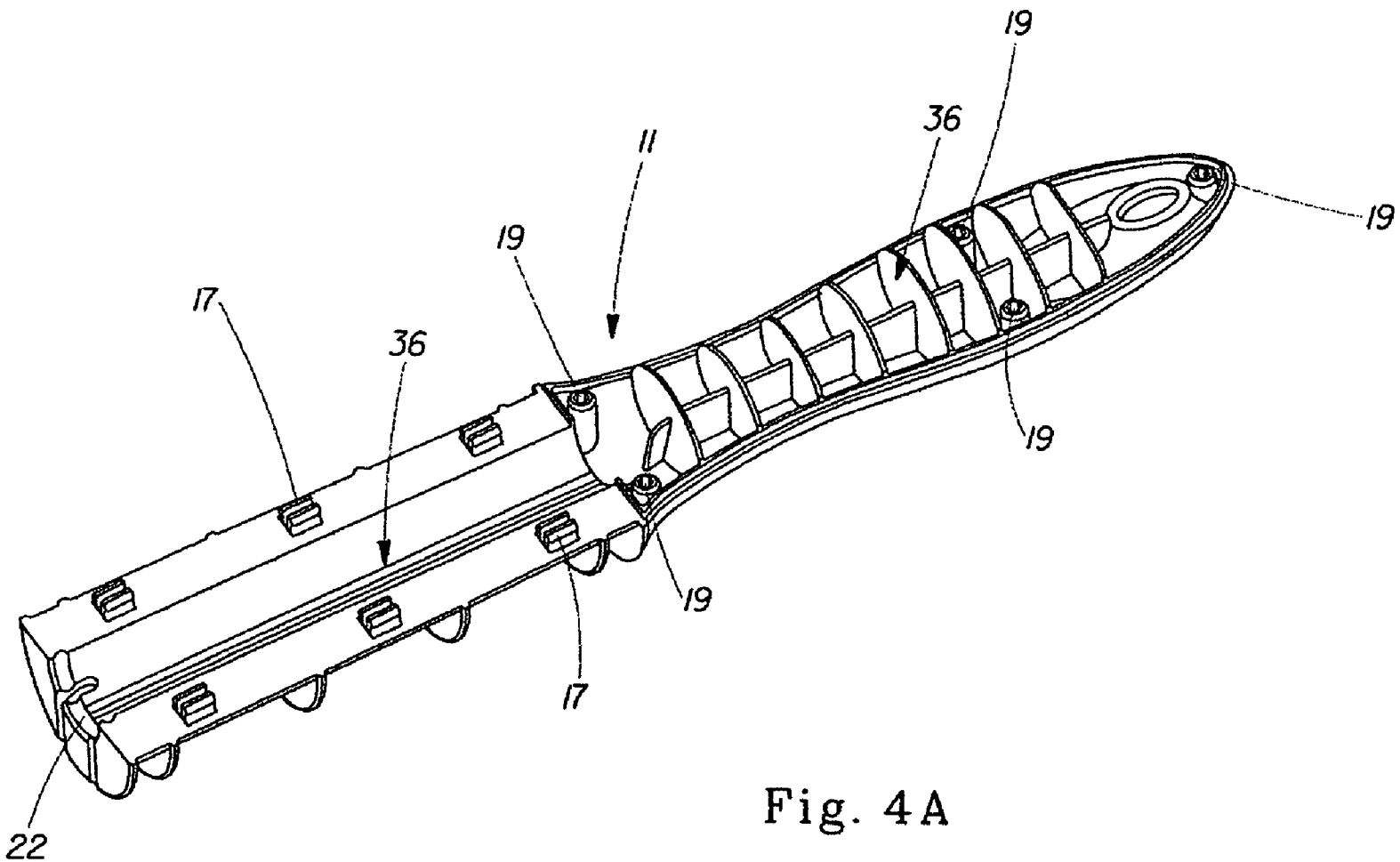
FIG. 4*a* is a perspective view of the inside of the first housing of FIG. 4.

Referring to FIG. 4*a*, the interior of first housing 11 is shown. The interior includes male snaps 17 and female octagonal attachments 19 to retain first housing 11 to second housing 12. Female shaft snap 22 mates with male retaining snap 35 on cover 30 in order to retain cover 30. Reinforcement ribs 36 provide reinforcement/structural integrity to both first housing 11 and second housing 12 when they are assembled together.

Referring to FIG. 5, the exterior of second housing 12 is shown. Second housing 12 includes radial ribs 15, axial ribs 16, female snaps 18 for mating with male snap 17 (shown in FIG. 4*a*) and male attachment post 20 for mating with female octagonal attachments 19 (shown in FIG. 4*a*) and vent slots 24. When using a substrate 40 which includes a benefit agent such as a perfume, vent slots 24 help facilitate transfer of the fragrance from substrate roll 40 to the environment. Radial ribs 15 are connected by axial ribs 16 to allow substrate roll 40 to slide onto hub 14.

Referring to FIG. 5 A, the interior of second housing 12 is shown. The interior of second housing 12 includes female snaps 18, vent slots 24, male attachment post 20, female shaft snap 22, and cover stop 34. Cover stop 34 prevents cover 30 from being forced into substrate roll 40 and damaging the substrate roll 40 allowing for a clearance between cover 30 and substrate 40.

FIG. 6 shows handle 10 and hub 14. Guide shaft 21 is located in the center of hub 14. Guide shaft 21 works in conjunction with guide post 31 of cover 30.

Figure 7:
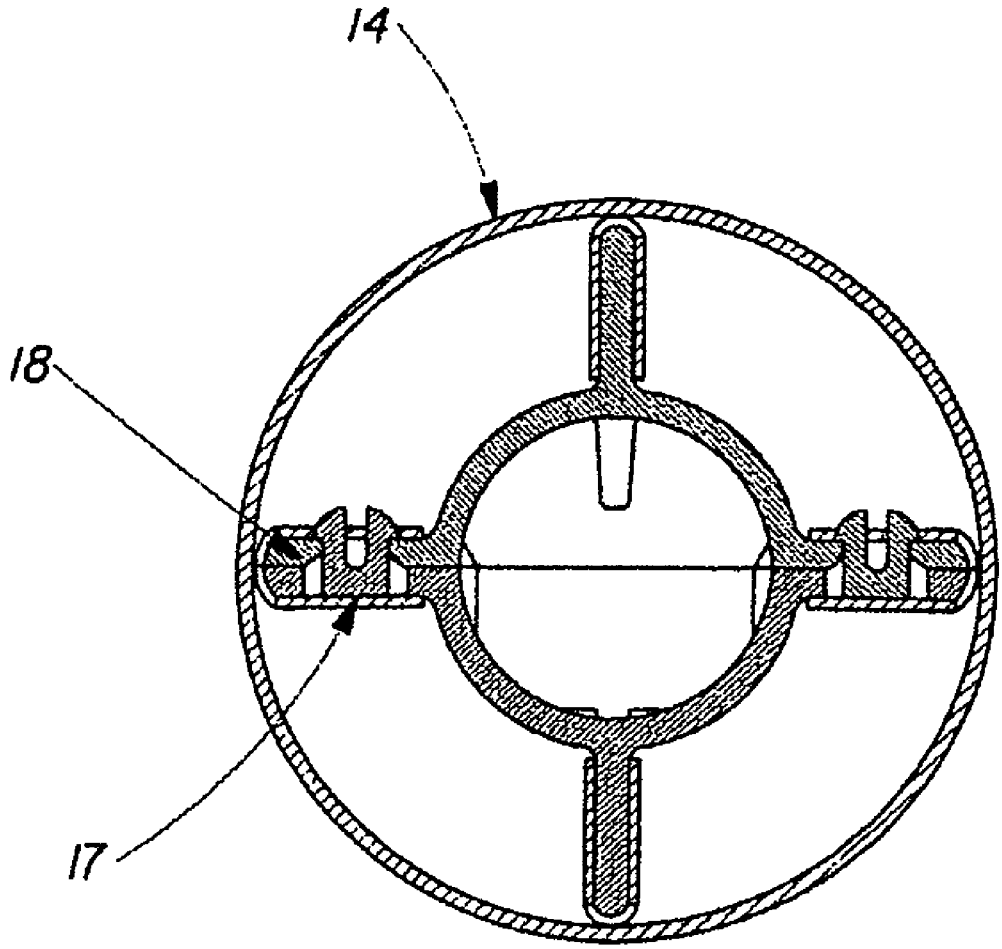
FIG. 7 is a cross-sectional view of the handle of FIG. 6 taken along line 7-7.

FIG. 7 shows a cross sectional view of female snap 18 and male snap 17 of hub 14.

Figure 8:
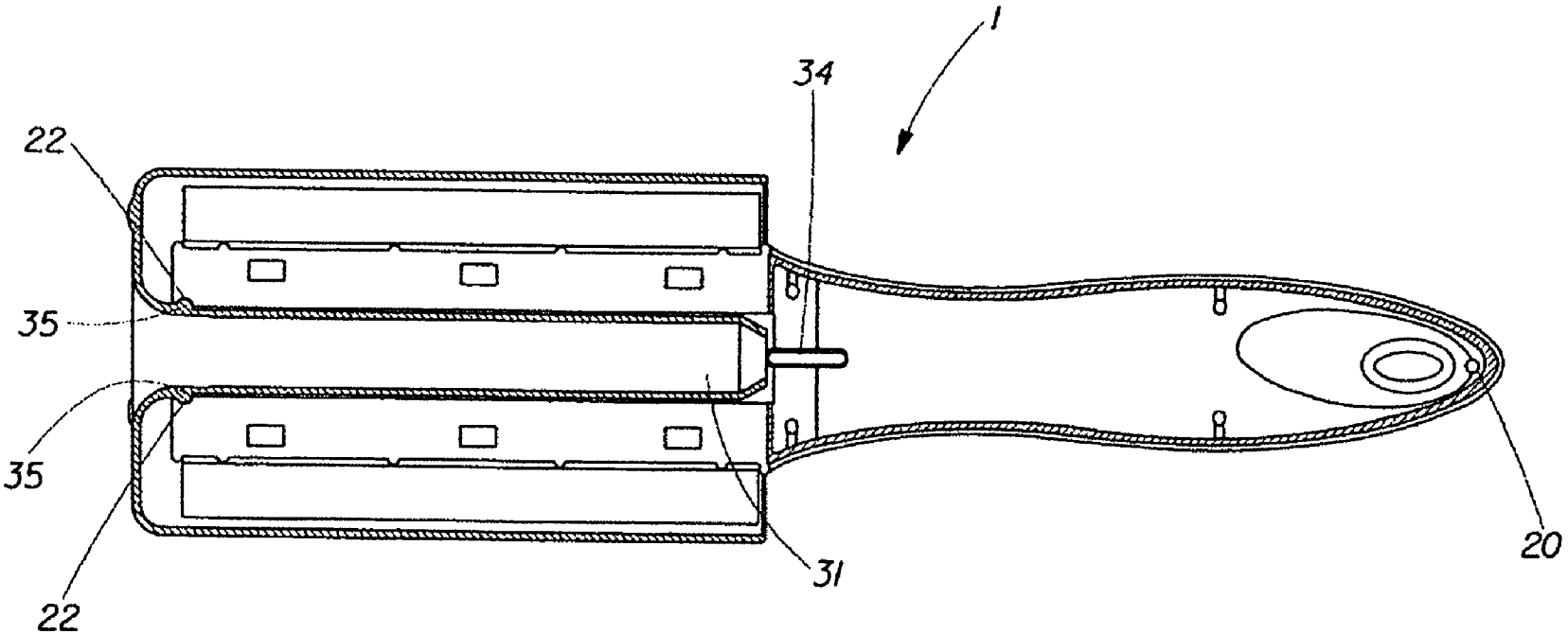
FIG. 8 shows an axial cross-sectional view taken along line 8-8 of FIG. 1.

FIG. 8 shows an axial cross-sectional view of roller article 1 which includes female shaft snap 22 for facilitating retention of male retaining snap 35 of cover 30. Also shown is guide post 31, male attachment post 20, and cover stop 34.

Figure 9:
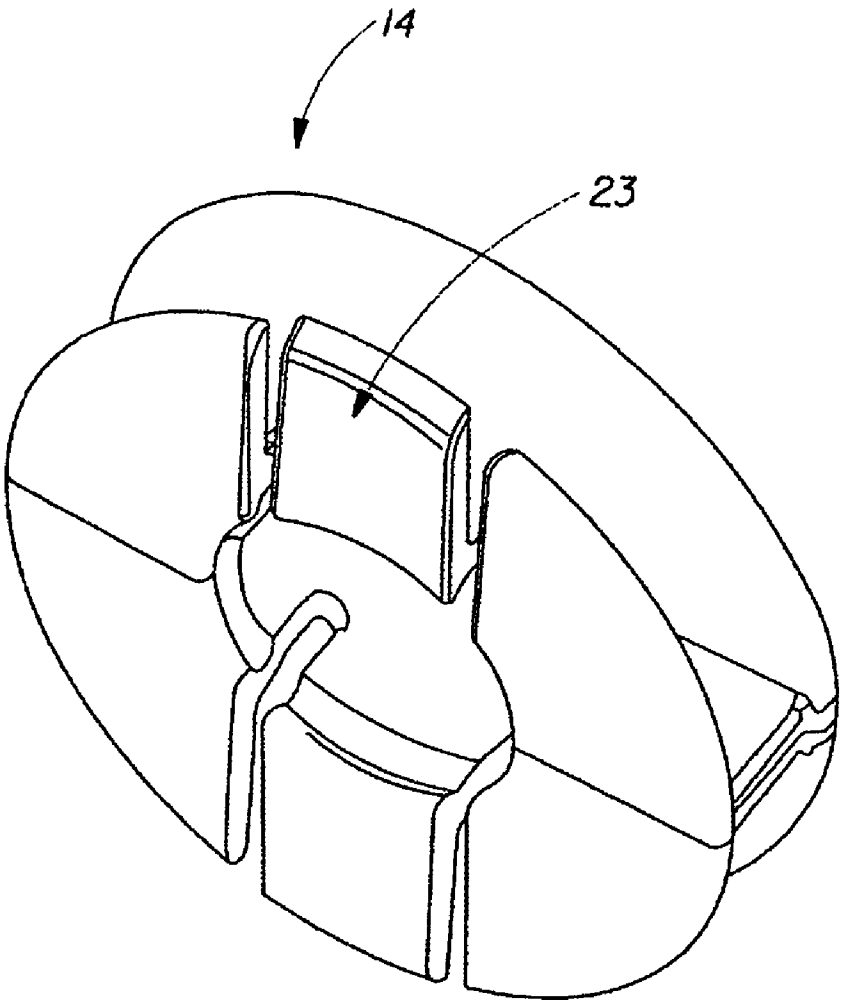
FIG. 9 is a top view of the hub of FIG. 6.

FIG. 9 shows a top view of hub 14 which shows substrate retaining tab 23. Substrate retaining tab 23 may be a flexible tab.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention. All documents cited herein are in relevant part, incorporated by reference. The citation of any document is not to be construed as an admission that it is prior art with respect to the present invention.

What is claimed is:

1. A roller article, said roller article comprising:

a handle, a substrate roll, and a cover, said handle comprising two halves non-symmetrical to each other including a first housing and a second housing that attach together, said cover including a cover guide post, wherein said handle includes a roller hub which includes a guide shaft for receiving said cover guide post, said guide shaft comprising a circumferentially continuous female snap; wherein said guide post comprises a circumferentially continuous male retaining snap on outside surface of said guide post and wherein said male snap engages said female snap on said guide shaft; wherein said substrate roll is placed on said roller hub, wherein said substrate roll comprises a perfume and wherein the handle further comprises a plurality of vent slots suitable for facilitating transfer of fragrance from the perfume to the environment;

wherein said cover covers the substrate roll when said male snap is engaged with said female snap.

2. The roller article of claim 1 wherein said cover guide post is axially aligned with said hub.

3. The roller article of claim 1, wherein said handle includes a cover stop.

4. The roller article of claim 1, wherein said guide post further comprises a circumferencially continuous lead-in taper.

5. The roller article of claim 1, wherein said first housing further comprises one or more radial ribs.

6. The roller article of claim 5, wherein said first housing further comprises one or more axial ribs.

* * * * *

UNITED STATES PATENT AND TRADEMARK OFFICE

CERTIFICATE OF CORRECTION

PATENT NO. : 7,841,036 B2
APPLICATION NO. : 11/177117
DATED : November 30, 2010
INVENTOR(S) : Smith It is certified that error appears in the above-identified patent and that said Letters Patent is hereby corrected as shown below:

Column 4

Line 60, delete "circumferencially" and insert --circumferentially--.

Signed and Sealed this
Thirtieth Day of August, 2011

David J. Kappos

David J. Kappos
*Director of the United States Patent and Trademark Office*